United States Patent [19]

Henderson

[11] 4,294,365

[45] Oct. 13, 1981

[54] COMBINED DART RACK AND SAFETY DEPOSITORY

[76] Inventor: Ellsworth S. Henderson, 9532 Lamar St., Spring Valley, Calif. 92077

[21] Appl. No.: 91,705

[22] Filed: Nov. 6, 1979

[51] Int. Cl.[3] ..... A47F 7/00

[52] U.S. Cl. ..... 211/60 R; 206/315 R; 211/87; 248/205 A

[58] Field of Search ..... 211/60 R, 69.5, 13, 211/87, 88; 273/416; 248/205 A; 206/315 R, 579

[56] References Cited

U.S. PATENT DOCUMENTS

| | | | |
|---|---|---|---|
| 2,937,910 | 5/1960 | Randa | 248/205 A X |
| 3,176,662 | 4/1965 | Williams | 211/60 R X |
| 3,217,891 | 11/1965 | Weaver | 211/60 R |
| 3,269,550 | 8/1966 | Marcus | 211/87 |
| 4,105,119 | 8/1978 | Cowan | 211/60 R X |

FOREIGN PATENT DOCUMENTS

| | | | |
|---|---|---|---|
| 2037665 | 2/1972 | Fed. Rep. of Germany | 211/69.5 |
| 650068 | 2/1951 | United Kingdom | 206/315 |
| 1342597 | 1/1974 | United Kingdom | 206/315 |

*Primary Examiner*—Roy D. Frazier
*Assistant Examiner*—Robert W. Gibson, Jr.
*Attorney, Agent, or Firm*—Knox & Knox

[57] ABSTRACT

A dart rack designed to protect the darts against deformation and to give reasonable protection against injury from the sharp points of the dart spike tips, as well as merely racking the darts, the rack being adapted for easily removable securement to a wall or the like. The rack has cylindrical sockets to receive the spike tips, said sockets having annular countersunk seats for the terminals of the weighted bosses conventionally provided on the darts at the base of the spike on each dart, and these countersunk seats have a relatively more important function in guiding the spikes into the sockets when a player is replacing the darts into the rack, the sockets also being positioned on the body of the dart rack to offset the darts away from a wall surface on which the dart rack is mounted so that the flights or vanes are prevented from being deformed by wall contact, and the sockets are also dimensioned to sheathe the spikes of the darts for fuller protection of the spikes.

1 Claim, 5 Drawing Figures

FIG. 1
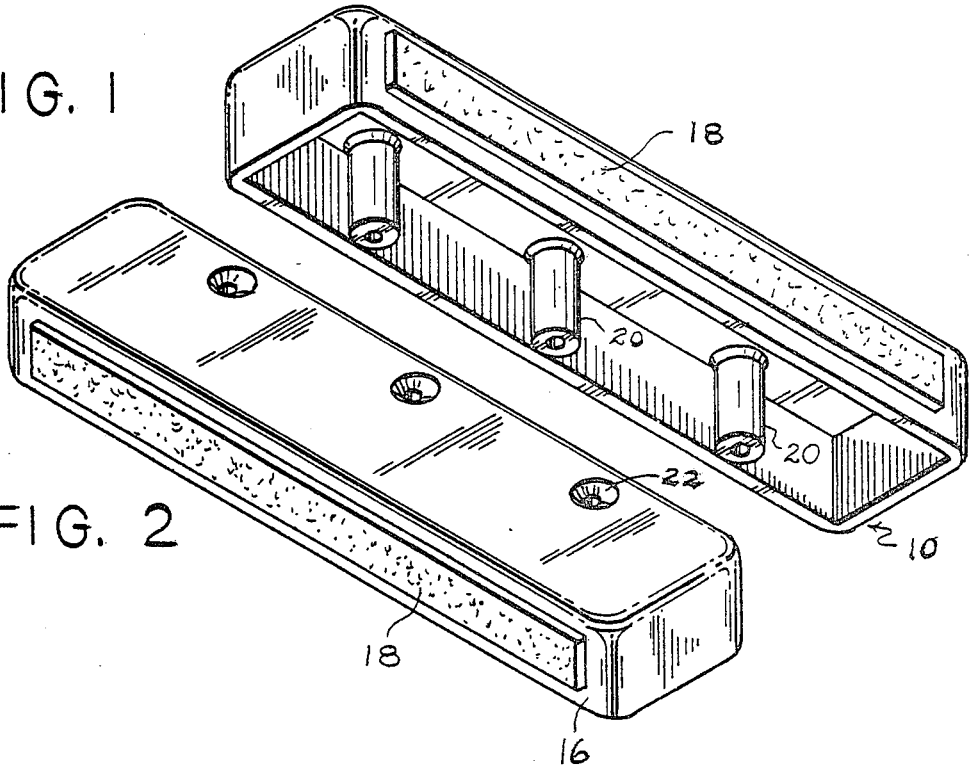
FIG. 2
FIG. 3
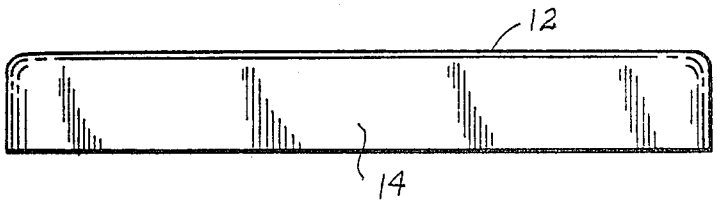
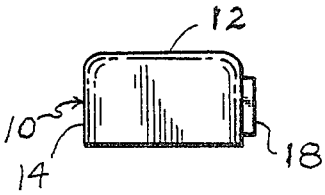
FIG. 4
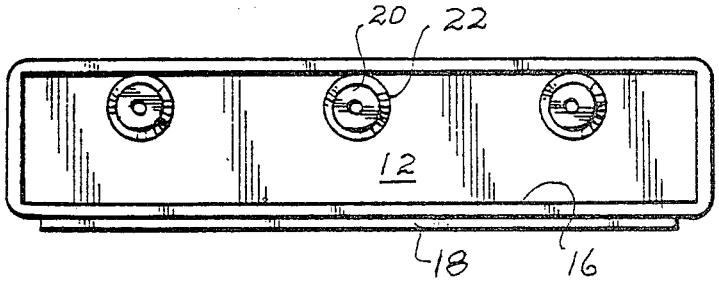
FIG. 5

COMBINED DART RACK AND SAFETY DEPOSITORY

BACKGROUND OF THE INVENTION

The problem of storage for darts when not in use is admittedly not complex but this problem has persistently existed, especially in homes and patios. Danger of injury by the sharp spike tips of the darts has compounded the problem when the darts are merely left in the last played position on the dart board since some of the darts will tend to loosen and fall after a time. A trough on the dart board assembly, if available, will provide only a haphazard and untidy storage. In fact, any storage means involving laying the darts to rest horizontally for extended periods will result in certain minor but functionally important deformation of the flights or vanes of the darts when the darts are re-used, and of course any such horizontal storage is likely to be impositive leading to misplacement and/or loss and damage to the darts especially when the darts fall to the floor. Applicant is aware of U.S. Patents disclosing dart and arrow holders numbered U.S. Pat. Nos. 2,179,471; 4,105,119; 330,216; 3,840,282; 4,121,719 and of Great Britain Pat. Nos. 668857 and 650068 disclosing pocket containers for darts.

SUMMARY OF THE INVENTION

As claimed the instant dart rack and safety depository solves the problems discussed above, this extremely simple item comprising a body with sockets therein incorporating the functions of simple but organized racking of the darts and protection for the darts, the item being self-supporting after being removably attached to a wall surface or the like by adhesive means representing maximum versatility and convenience in use, and the darts are not deformed by storage for even protracted periods.

BRIEF DESCRIPTION OF THE DRAWINGS

FIG. 1 is an isometric view of the dart rack and safety depository as viewed from the side with the wall attachment means thereon.

FIG. 2 is a similar view from the top.

FIG. 3 is a front elevational view of the item.

FIG. 4 is an end elevational view of the item.

FIG. 5 is a top plan view of the item.

DETAILED DESCRIPTION OF A PREFERRED EMBODIMENT

Referring to the drawing in which the same numerals refer to identical or like parts and portions in the different views, the item in its simplest form as illustrated in FIG. 1 has an elongated, generally rectangular hollow box-like three-dimensional body 10 with a top 12 which may be flat as shown. The longitudinal front side wall 14 and its similar rear side wall 16 are also preferably flat and as the item is used these side walls 14 and 16 are ordinarily vertical and will be so referred to in this description.

One of the vertical side walls, the side 16 as illustrated, has a strip of adhesive material 18 affixed thereto, this strip 18 being generally co-extensive with the side on which it is fixed and being capable of supporting the body 10 when applied to a wall surface or the like. The commercially available so-called twosided adhesive strip material may be employed and as the item is merchandised a removable protective layer of paper or the like, not shown in the drawing, covers the outer adhesive surface of the strip 18 prior to attachment of the item to a wall surface.

The body 10 has a plurality of hollow cylindrical portions hereinafter referred to simply as the sockets 20 regularly spaced therealong and extending from the top 12 to the plane of the bottom of the body 10. The upper ends of the sockets 20 are chamferred or countersunk to provide annular seats 22 for the lower terminals of the conventional weighted bosses of the darts, not shown. The most important function of the seats 22 is, however, to guide the spikes of the darts into the sockets 20 when being replaced by the player. In the interest of economizing on material and minimizing weight the sockets 20 are formed as tubes integral with the top 12 as is conventional in plastic manufacturing procedures and as indicated in FIGS. 1, 2 and 5. The lower terminals of the thus formed sockets as shown are co-planar with the adjacent lower edges of the sides 14 and 16.

As illustrated in FIG. 1 the sockets 20 are offset toward the side wall 14 of the body 10 to space the darts well away from the supporting wall surface and thus to protect the flight or vaned portion of the darts from contact with said supporting wall and consequent deformation of the flight. The sockets are open-bottomed and 20 are long enough for the complete sheathing of the spike tips 28 of the darts giving protection against the sharp points.

It will be noted that the item can be reversed, end to end, for mounting to the left or right hand side of the player.

What I claim as new and desire to secure by Letters Patent, is:

1. A combined rack and safety depository for game darts having a spike tip and weighted boss at the base of the spike tip, said rack and safety depository comprising:

(a) an elongated, one-piece, generally rectangular simple parallelepiped hollow box-like body having a horizontal flat closed top, an open bottom and substantially vertical side walls when the rack is oriented as in use;

(b) adhesive, no-mar attachment means on one of said side walls enabling said body to be readily removably mounted on a wall surface with said top extending horizontally along and normal to said wall surface;

(c) said body having separate free standing cylindrical sockets extending normal to said top from said top substantially to the plane of the bottom of said body for substantially completely sheathing and protecting the spikes of said darts and said sockets having countersunk annular portions at said top functioning as guides to direct dart spikes into said sockets and also to serve as seats to receive terminals of said bosses, said sockets being offset horizontally from a longitudinal vertical center plane of said body toward the other of said vetical side walls to space darts well away from said wall surface so that the flights of said darts are not damaged by wall contact and finger access to said darts is assured, the lower ends of said sockets being open.

* * * * *